US010470973B2

(12) United States Patent
Machado Pires

(10) Patent No.: US 10,470,973 B2
(45) Date of Patent: Nov. 12, 2019

(54) DRUG DISPENSING DEVICE

(71) Applicant: Catarina Sofia Machado Pires, Oporto (PT)

(72) Inventor: Catarina Sofia Machado Pires, Oporto (PT)

( * ) Notice: Subject to any disclaimer, the term of this patent is extended or adjusted under 35 U.S.C. 154(b) by 0 days.

(21) Appl. No.: 16/096,197

(22) PCT Filed: Apr. 27, 2017

(86) PCT No.: PCT/IB2017/052431
§ 371 (c)(1),
(2) Date: Oct. 24, 2018

(87) PCT Pub. No.: WO2017/187376
PCT Pub. Date: Nov. 2, 2017

(65) Prior Publication Data

US 2019/0133883 A1 May 9, 2019

(30) Foreign Application Priority Data

Apr. 29, 2016 (PT) ..... 109353

(51) Int. Cl.
*A61J 1/16* (2006.01)
*A61J 1/06* (2006.01)
*A45C 11/00* (2006.01)

(52) U.S. Cl.
CPC ..... *A61J 1/16* (2013.01); *A45C 11/00* (2013.01); *A61J 1/067* (2013.01); *A45C 2011/007* (2013.01)

(58) Field of Classification Search
CPC ..... A45D 34/00; A45F 2005/008; A45F 3/20; A61J 1/16; A61J 1/067; A63B 2225/682
USPC ..... 224/222, 148.4; 222/175, 206, 212, 214
See application file for complete search history.

(56) References Cited

U.S. PATENT DOCUMENTS 4,153,185 A * 5/1979 Nilson ..... B65D 83/0094 222/212
5,439,143 A * 8/1995 Brown ..... B65D 47/2031 222/185.1
6,173,866 B1 * 1/2001 Taylor, Jr. ..... A45F 3/20 222/175

(Continued)

OTHER PUBLICATIONS

International Search Report and Written Opinion dated Aug. 4, 2017 for PCT/IB2017/052431 and English translation.

*Primary Examiner* — Adam J Waggenspack
(74) *Attorney, Agent, or Firm* — Lucas & Mercanti, LLP

(57) ABSTRACT

The present application describes a drug dispensing device. The device is comprised of an armband, a rigid housing, made of polymeric or composite material, with any geometric shape, which separates in two along the longitudinal axis, incorporating therein a capsule containing a concentrated fluid whose geometric shape allows its storage within said housing. The centre of the top of one of the capsule faces contains a valve which, upon being actuated by at least one flexible tab, by pressing the mouth of the user, is expelled from the inside of the capsule, allowing him to suck the concentrated fluid contained therein. In this way, the device allows the user to correct the reference values quickly and effectively and thus regain the sense of physical safety while practicing sports in extreme situations or while practicing activities in water environments.

12 Claims, 6 Drawing Sheets

(56) References Cited

U.S. PATENT DOCUMENTS

| | | | | |
|---|---|---|---|---|
| 7,316,332 | B2 * | 1/2008 | Powers | A45D 34/00 222/1 |
| 9,089,190 | B2 * | 7/2015 | Booker | A44C 5/0023 |
| 2005/0124945 | A1 | 6/2005 | Powers et al. | |
| 2010/0237115 | A1 | 9/2010 | Booker | |
| 2015/0158042 | A1 | 6/2015 | Parker et al. | |

* cited by examiner

DRUG DISPENSING DEVICE

CROSS REFERENCE TO RELATED APPLICATION

This Application is a 371 of PCT/IB2017/052431 filed on Apr. 27, 2017, which, in turn, claimed the priority of Portuguese Patent Application No. 109353 filed on Apr. 29, 2016, both applications are incorporated herein by reference.

TECHNICAL FIELD

The present application describes a drug dispensing device.

BACKGROUND

Hypoglycemia is a disorder caused by low glucose concentration, or sugar, in the blood that mainly affects people with diabetes or hypotension. Symptoms occur unexpectedly, arising uncontrollably and suddenly, leading to serious consequences such as loss of consciousness, which can lead to coma and, consequently, death.

The only solutions presented today to the patient for the correction of a hypoglycemia episode by those skilled in the art are the traditional sugar packets that cannot be carried into water because they will inevitably be diluted and even out of water, they eventually rip wherever they are carried, making it impossible to consume them.

Other solutions presented today for the correction of a hypoglycemia episode also include the intake of candy, extremely damaging to the teeth, which candies rapidly age and stick to the wrap paper or plastic surrounding them, becoming sticky and once again making it impossible to consume them, or also the intake of quick-acting and high-sugar soft drinks with a minimum capacity of 200 mL, which cannot be carried along at the patient's body into water and which are often uncomfortably carried even out of water.

Firstly, the solutions currently presented for the correction of a hypoglycemia episode do not take the water factor into consideration. It is noteworthy that in water environments there are numerous adversities for the patient, namely that glucose is necessarily on land, making it difficult to be reached within vital time, but also the impossibility for the patient to carry along, as is advisable and usual, sugar packets, candies or soft drinks, which inevitably compromises the correction of a hypoglycemia episode, thus representing a risk to the patient's life.

This reality leads the patient to be deprived of certain activities upon fear of a hypoglycemia episode that puts his life at risk, thus inhibiting the patient to have access to the practice of physical activities or of some sports mainly in water environments, for safety reasons.

The device now disclosed allows overcoming the problems mentioned with prior art devices and can be applied for purposes other than hypoglycemia correction.

SUMMARY

The present application describes a drug dispensing device comprising a rigid housing which separates in two along its longitudinal axis, composing a lower part and an upper part comprising at least one tab, and which store, in the inner space formed by both parts, a capsule containing a valve positioned in the centre of the face contacting the upper part of the housing.

In one embodiment, the drug dispensing device comprises an armband consisting of an elastic band and a band including hook and loop fastener such as that sold under the trademark Velcro®, the first half consisting of the hook side and the second half consisting of the loop side, both resting on a strip.

In another embodiment, the strip used in the drug dispensing device is made of neoprene.

In yet another embodiment, the rigid housing of the drug dispensing device is composed of polymeric or composite material.

In one embodiment, the tabs of the drug dispensing device are symmetrical with each other.

In another embodiment, the capsule of the drug dispensing device is composed of polymeric material.

In yet another embodiment, the lower part of the housing and the upper part of the housing of the drug dispensing device comprise a recess.

In one embodiment, the drug dispensing device comprises a thread screw system for the connection between the lower part of the housing and the upper part of the housing.

In yet another embodiment, the lower part of the housing and the upper part of the housing of the device are symmetric in capacity, being separated and joined in the longitudinal axis of symmetry.

In one embodiment, the lower part of the housing of the drug dispensing device comprises a U-shaped part.

In another embodiment, the lower part of the housing of the drug dispensing device comprises two symmetrical bores through which the elastic band passes and slides.

In another embodiment, the armband end contains a locking part made of metal or other resistant material, slightly wider than it, so as to make it difficult, although not impossible, for the end of this strip to pass through the buckle, for safety purposes.

GENERAL DESCRIPTION

The present application describes a drug dispensing device. This device can be carried in a removable way around the arm, allowing immediate correction of the reference values in order to avoid user loss of consciousness in adverse situations, for example, during sports under adverse situations especially in water environments.

Throughout the present application, reference values are considered to refer to values obtained through diagnostic tests and which enable said diagnosis and determination of the patient's condition. Throughout the present application, it is further envisaged that the fluid or drug relates to the fluid, solid, gel or powder which allows the user to correct his reference values to the normal range and thereby overcome the symptoms of the disease.

The technology now disclosed relates to a lightweight, small and adaptable drug dispenser having at least one replaceable, waterproof capsule containing a concentrated fluid, conveniently and releasable carried around the arm, allowing immediate correction of the reference values in order to avoid loss of consciousness of the patient in adverse situations, such as sports under several adversities especially in water environments, namely: on the one hand, the fluid or drug is unavoidably on land, making it difficult to be reached by the patient within vital time, and, on the other hand, the impossibility for the patient to carry along, as usual, sugar packets, drugs or other products, close to the body since they will dissolve in the water, making it impossible to correct the reference values and also placing the life of the patient at risk.

The capsule is replaceable and pre-filled with the required and regulated amount to correct the reference values, which inevitably implies greater safety and hygiene (the fluid is inevitably "sterilized") and safety of the quality and function of the fluid ingested. The fact that the capsule is replaceable is an advantage over the devices which need to be refilled since glucose and other products, due to their viscosity or sugar amount, cause the walls of said devices to become increasingly clogged, which prevents its future refill.

This device allows the user to permanently have the fluid or drug required to correct the reference values to the normal range in possession and within reach, which reflects in an improved quality of life, in overcoming fear, in achieving the sense of self-confidence and freedom necessary to carry out simple daily life activities, but above all to practice sports in extreme situations and in water environments, without risks to the health or life of the patient.

This device is carried along next to the body, preferably around the arm and comprises therein a capsule containing the fluid or drug, the capsule consisting of a resistant material which is impermeable not only to water but also to different levels of humidity and gases, being also submersible, able to undergo high and low temperatures, high and low pressures and altitudes, guaranteeing the constant preservation of the contents of the capsule. The material used in this capsule shall be any included in the regulations concerning materials intended to come into contact with food and/or pharmaceutical products.

In this way, the device allows the user to recover a sense of physical safety while practicing some sports in extreme situations, such as mountaineering, skydiving, hang gliding, paragliding, hockey or jogging and, in particular water environment activities, such as surfing, diving, windsurfing, kite surfing, rowing, bodyboarding, canoeing, rafting, paddle boarding, triathlon, diving or simply sailing, bathing in sea, lake or river water, safely without putting the health or life at risk.

The device disclosed is desirably light, small and adaptable, and can be adjusted to be placed around the user's arm by means of an armband, which may comprise a band including hook and loop fastener such as that sold under the trademark Velcro®, wherein the first half consists of the hook side and the second half consists of the loop side, both resting on an elastomer, for example neoprene strip or the like, so as to allow adjusting the diameter to the user's arm through a buckle and another part consisting of an elastic band.

The device comprises a rigid housing made of polymeric or composite material in any geometric shape, which separates in two along the longitudinal axis, resulting in two parts with the same capacity: a concave lower part, the outer face of which is provided with means for passing and sliding of an elastic band which favors the attachment of the device to the user's member, and a convex upper part having at its top at least one flexible tab. The tabs are flexible so as to allow pressing of the capsule to expel the valve.

Alternatively, the lower part of the housing may comprise two symmetrical bores for passing and sliding of the elastic band. If more than one tab is used in the upper part of the housing, its arrangement may be symmetrical to one another, wherein the ends taper towards the centre of the top of the part without them touching. The present device also comprises a capsule whose geometric shape allows it to be confined within the inner space composed by both parts of the housing, said capsule containing a fluid or drug. This capsule may be made of a flexible and resistant polymeric material suitable for food or medical use, impermeable to water and gases, submersible, able to undergo high and low temperatures, high and low pressures, but also to different humidity levels. This material may be synthetic as low density polyethylene (LDPE) or natural, derived from cellulose, casein or rubber. LDPE is non-toxic, flexible, lightweight, inert (to the content), impervious to oxygen and offers humidity protection while retaining its flexibility at low temperatures (−50° C.). The material employed may be multi-layered including several plastic and aluminium materials, the latter layer acting as a light, oxygen and foul smell shield.

In the centre of one of the capsule faces, which is in contact with the upper part of the housing, a valve is positioned. This valve is actuated by the pressure of the user's mouth on the capsule itself upon pressure of at least one flexible tab. In this way, the valve is expelled from the inside of the capsule, allowing suctioning of the fluid or drug contained therein which, once ingested, enables the user to correct the reference values quickly and effectively.

The valve present in the capsule, under normal non-use conditions, is protected by the housing, in particular by its upper part, and by the material of the capsule itself in which it is withdrawn until being ejected, thus preventing it from being damaged in more extreme scenarios or sports, whether in or out of water. Only upon actuation, by the pressure of the tabs on the capsule itself, the valve is expelled thus becoming external to the boundary of the upper part of the housing and being accessible to the user who may then suck the fluid or drug contained in the capsule.

The use of a valve in the capsule is the safest, easiest and most intuitive way of handling the device in view of its application scenario. This is indeed a strategy which avoids the use of a plurality of non-joined parts which would, for example, have to be unscrewed, disengaged or detached in order to release access to the fluid contained within the capsule, which would necessarily imply greater difficulty/complexity in handling the device itself, but also a greater risk to the safety of its user. Instead, by means of said valve, the device operates under pressure, which may be caused by the mouth of the user, even in the water, requiring no hand to press the capsule.

To this end, the action of the flexible tabs, present in the upper part of the housing, is a contribution, which together with the pressure exerted, allow the valve to be expelled. Since being a "hands-free" device, it will allow the practice of sports such as mountaineering, kitesurfing, windsurfing, among others, in which hands are inseparable from the practice of this type of activities.

The fluid or drug contained in the capsule, in the case of a fluid, has a gelatinous density of between 1.3 and 1.8 g/mL so as not to pour or cause any risk of diluting if it comes into direct contact with water, in case of any unforeseen event, so that the device is always used with the greatest safety possible.

Contrary to the existing methods, this drug dispensing device is innovative in that it first considers the humidity factor and can even be submerged by virtue of the characteristics of its inner capsule, which is impermeable, and the other materials used do not absorb water or dry out quickly due to their hydrophobic coating. This device is also easy to use and carry, is lightweight, compact, practical and adaptable to the size of any user.

The dispensing device, in addition to being impermeable and submersible, is also impermeable to different levels of humidity and gases, and may also undergo high and low temperatures, high and low pressures and altitudes, so as to cover various environments and different atmospheric conditions, assuring a constant conservation of the contents within the capsule.

The adaptive nature of this device shows, on the one hand, the added value of adapting to the physical constitution and the size of the arm of each user, from child to adult, providing different armband sizes, and on the other hand, the adaptability to a bicycle structure, such as a helmet, so that it does not have to be mandatorily placed close to the body, although being always close to the user for safety purposes.

The device has flexibility of use since the capsules, supported by the device, are replaceable, which on the one hand makes it more environmentally friendly, and on the other hand leads to a longer durability of the device as a whole, as opposed to the methods nowadays advised for the correction of reference values, which are impractical, unreliable, poorly resistant and impossible to be carried into water. Thus, the user may at all times keep the capsules with the fluid or drug which may also be carried inside a backpack, a wallet, a pocket, allowing any patient to adapt them to the relevant lifestyle, also in the practice of simple daily life activities, and always in total safety.

In addition to these factors, the technology now developed also takes account of the current reality and therefore this drug dispensing device seeks to address an existing need and to find a reliable, feasible and plausible solution for a target population of several million users, with a high tendency to grow if current lifestyles and current eating habits are taken into account, as well as the fact that child obesity has increased considerably and may lead to diabetes or hypotension.

Thus, in addition to the physical safety issues mentioned above, this device is also intended to help improve the quality of life of the user by helping to overcome the feeling of insecurity and fear, which are unavoidable characteristics of this type of condition when exposed to certain scenarios, and help the patient in gaining a new sense of confidence in total safety.

DESCRIPTION OF THE DRAWINGS

For an easier understanding of the technique, drawings are herein attached, which represent preferred embodiments and which, however, are not intended to limit the scope of the present application.

FIG. 1 shows a schematic view in exploded axonometry of the device with all its different components, wherein the reference numbers relate to:

Figure 1:
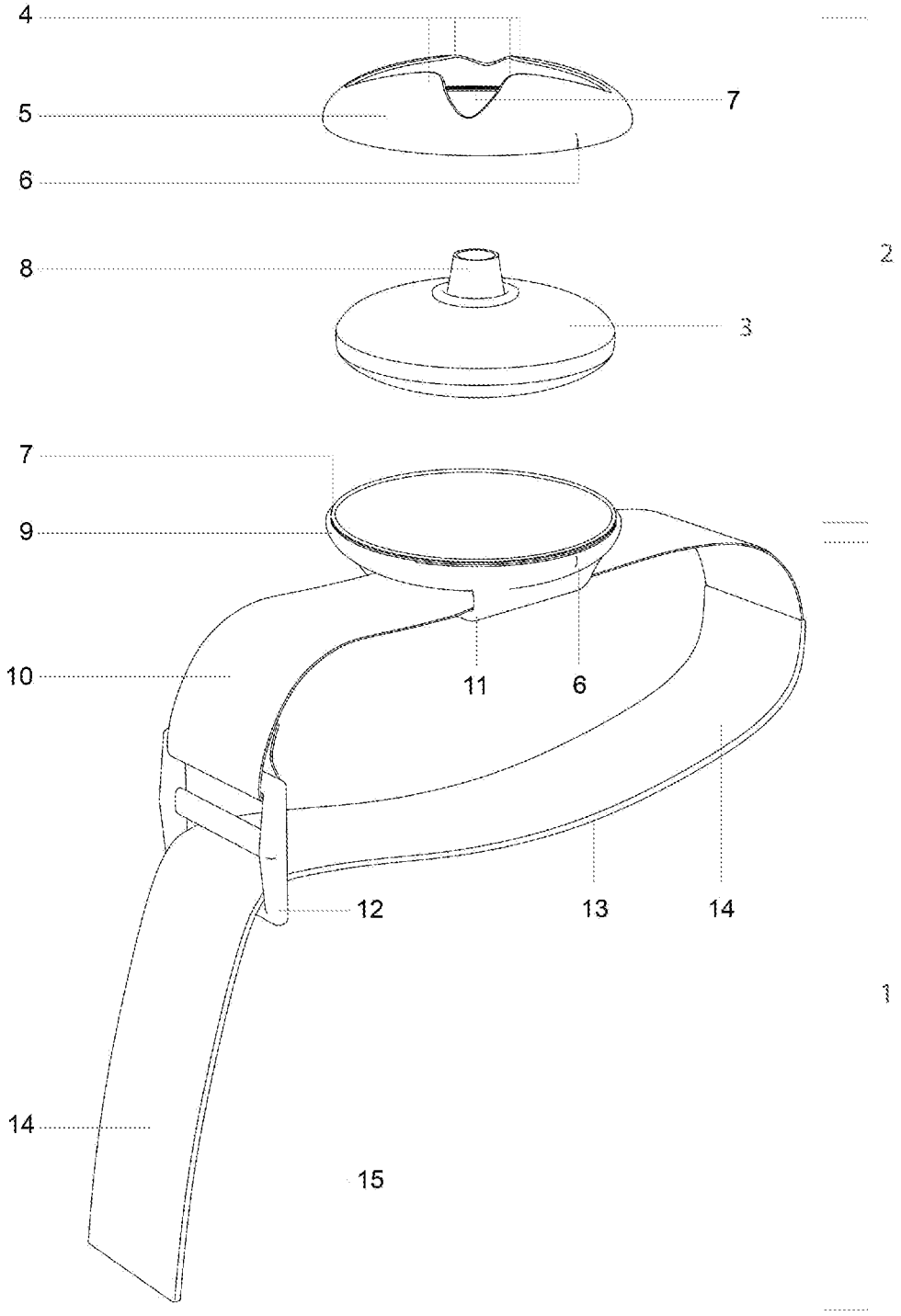
Figure 2:
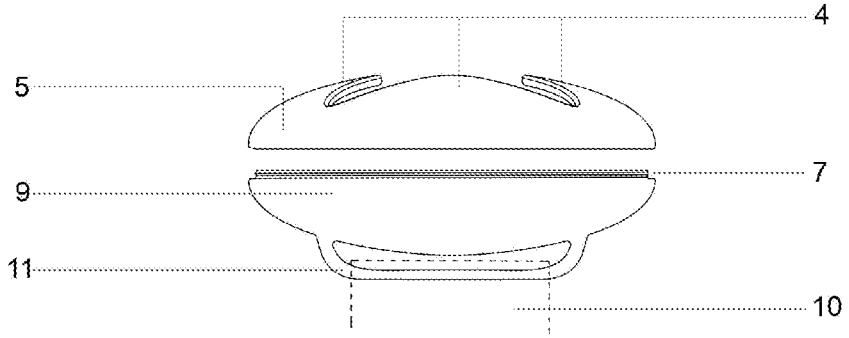

1—armband;
2—housing;
3—capsule;
4—tab;
5—upper part of the housing;
6—recess;
7—thread screw system;
8—valve;
9—lower part of the housing;
10—elastic band;
11—U-shaped part;
12—buckle;
13—loop;
14—strip;
15—hook;

FIG. 2 shows a schematic front view of the housing of the device illustrated in FIG. 1, wherein the reference numbers relate to:

4—tab;
5—upper part of the housing;
7—thread screw system;
9—lower part of the housing;
10—elastic band;
11—U-shaped part.

Figure 3:
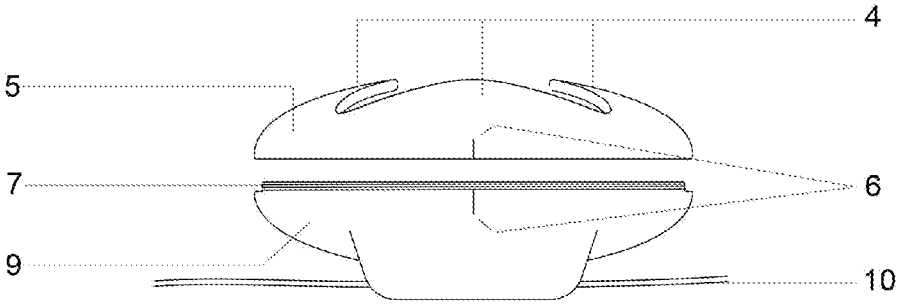

FIG. 3 shows a schematic side view of the housing of the device illustrated in FIG. 1, wherein the reference numbers relate to:

4—tab;
5—upper part of the housing;
6—recess;
7—thread screw system;
9—lower part of the housing;
10—elastic band.

Figure 4:
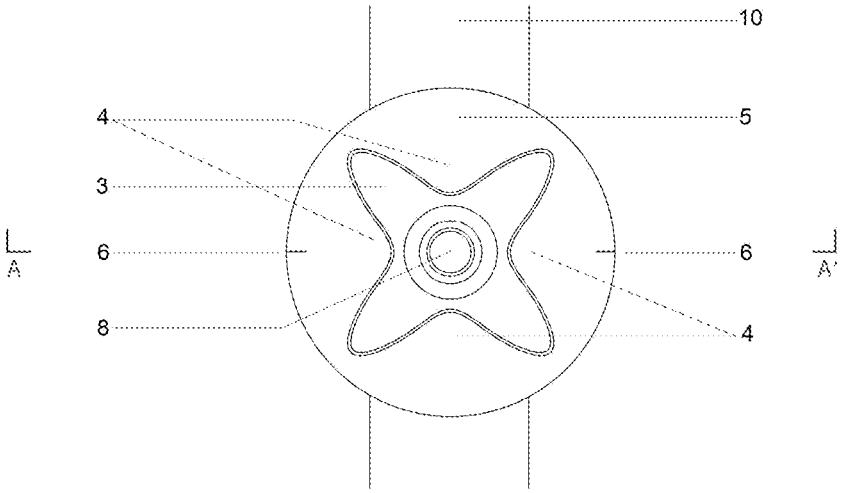

FIG. 4 shows a schematic top view of the housing where a section A-A' is indicated, wherein the reference numbers relate to:

3—capsule;
4—tab;
5—upper part of the housing;
6—recess;
8—valve;
10—elastic band.

Figure 5:
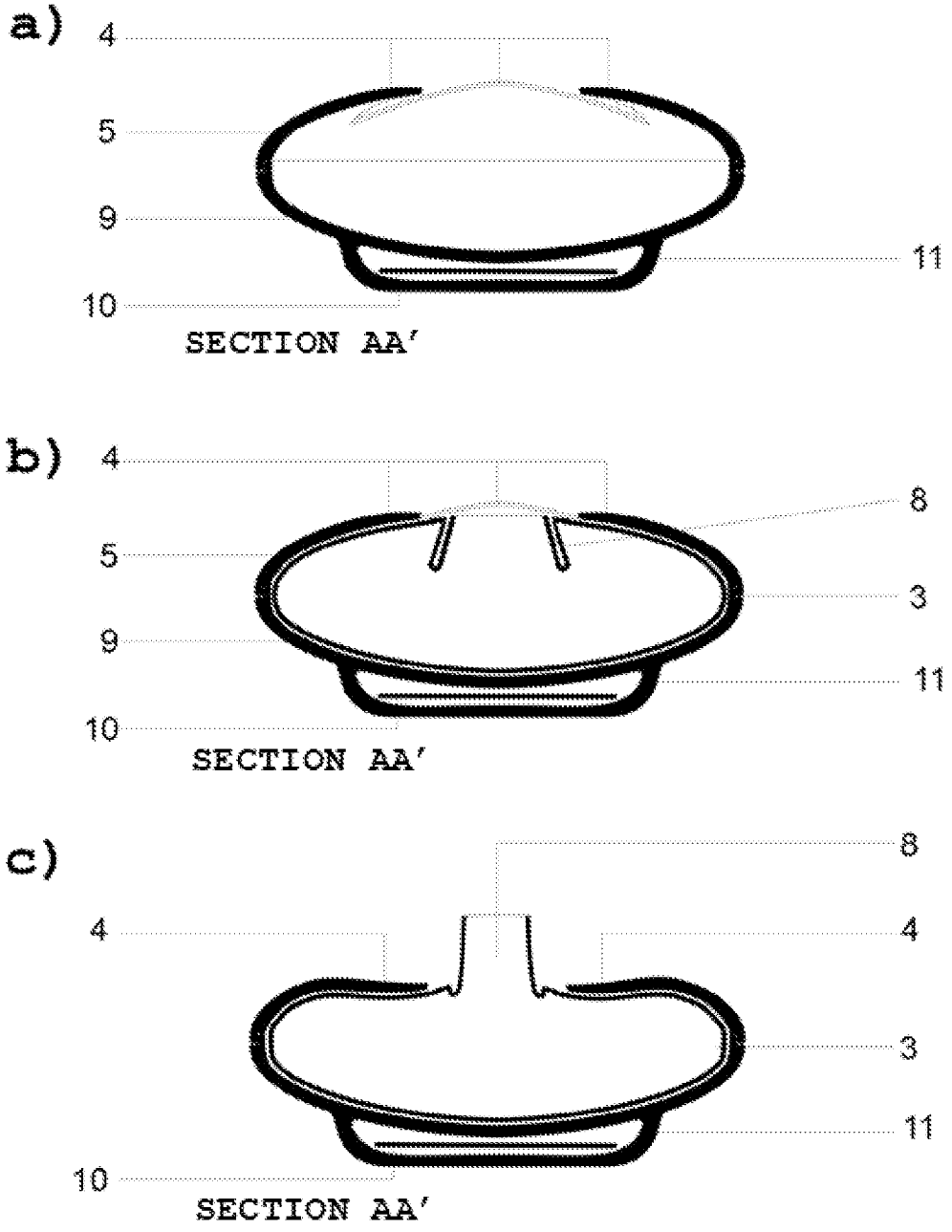

FIG. 5 shows a schematic view of the cross sections along the housing of the device, assembled as follows:

image a) is a view of the housing along section AA', without the capsule therein;

image b) is a view of the housing along section AA', with the capsule therein;

image c) is a view of the housing along section AA', with the tabs compressing the capsule therein, thus activating the respective valve and releasing its contents, wherein the reference numbers relate to:

3—capsule;
4—tab;
5—upper part of the housing;
8—valve;
9—lower part of the housing;
10—elastic band;
11—U-shaped part.

Figure 6:
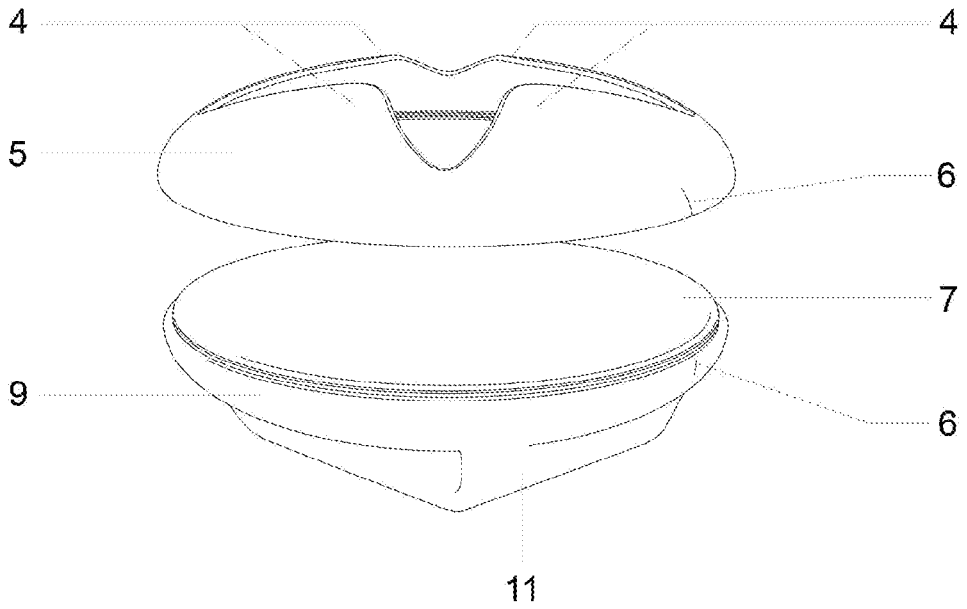

FIG. 6 shows a schematic perspective view of the housing of the device wherein the housing is open without a capsule, wherein the reference numbers relate to:

4—tab;
5—upper part of the housing;
6—recess;
7—thread screw system;
9—lower part of the housing.

Figure 7:
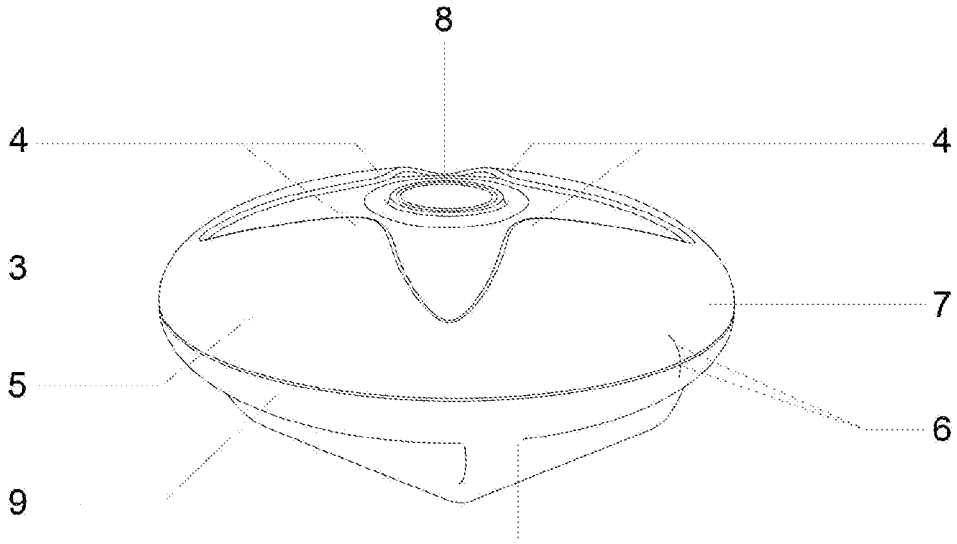
Figure 8:
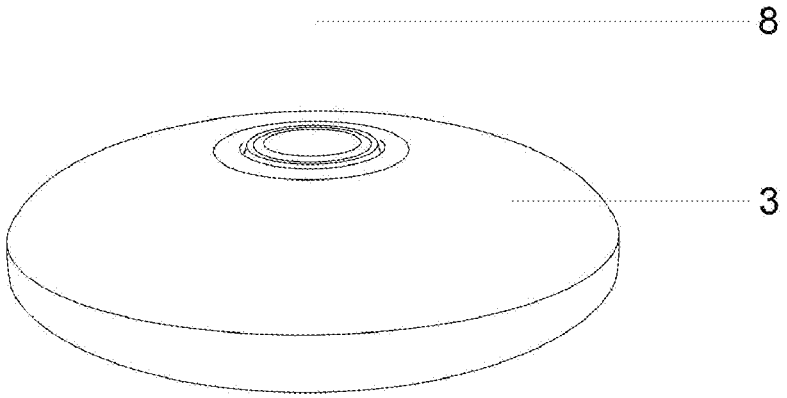

FIG. 7 shows a schematic perspective view of the housing of the device wherein the housing is fully closed with the capsule therein, with the valve yet to be activated, wherein the reference numbers relate to:

3—capsule;
4—tab;
5—upper part of the housing;
6—recess;
7—thread screw system;
8—valve;
9—lower part of the housing;

FIG. 8 shows a schematic perspective view of the capsule to be inserted into the housing with the valve embedded and yet to be activated, wherein the reference numbers relate to:

3—capsule;
8—valve.

Figure 9:
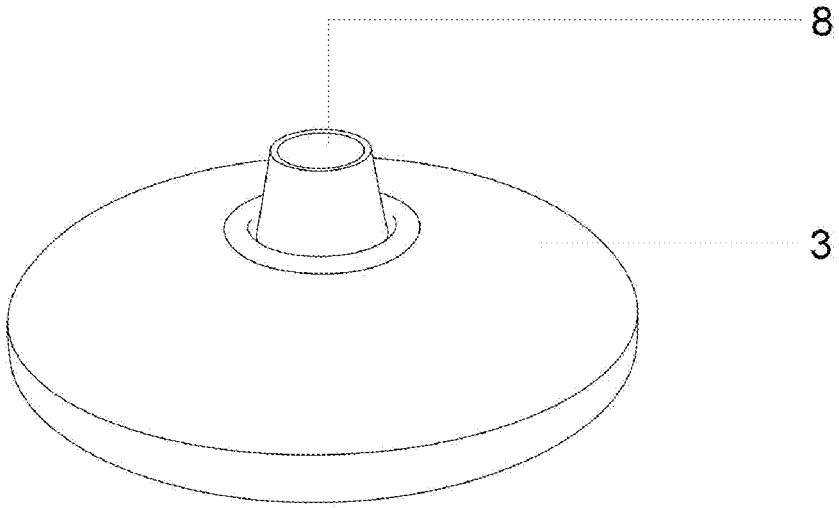

FIG. 9 shows a schematic perspective view of the capsule to be inserted into the housing with the valve facing upwards and activated, wherein the reference numbers relate to:

3—capsule;

8—valve.

Figure 10:
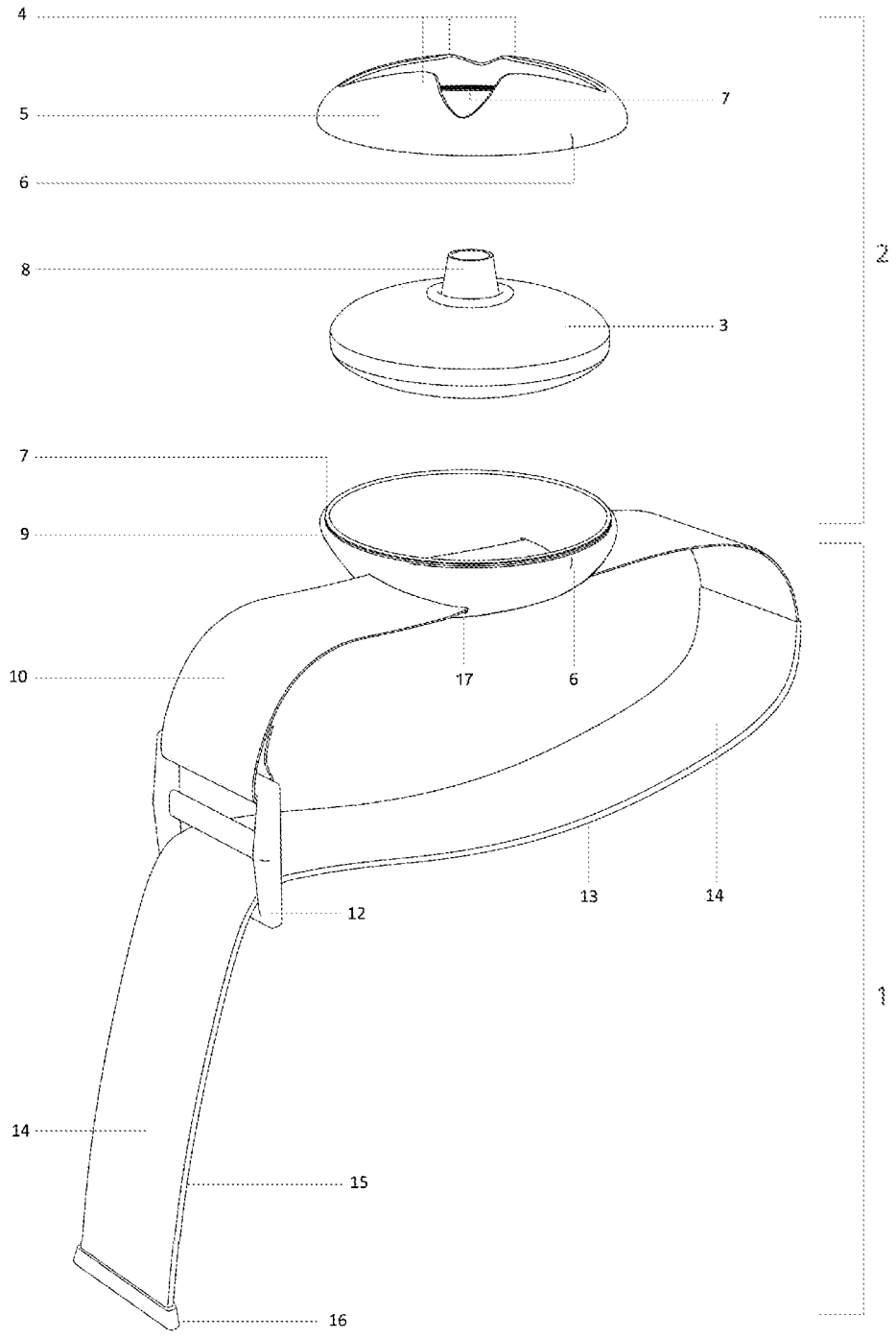

FIG. 10 shows a schematic view in exploded axonometry of the device with all its different components, wherein the reference numbers relate to those of FIG. 1, showing another embodiment of the technology, wherein the reference numbers relate to:

16—part in metal or other resistant material.

17—lower part of the housing of the drug dispensing device comprising two symmetrical bores through which the elastic band passes and slides.

DESCRIPTION OF THE EMBODIMENTS

Referring to the figures, embodiments of the technology will now be described with the aid of the accompanying drawings, which are not intended to limit the scope of the present application.

The present application describes a drug dispensing device. This device is light, small and adaptable and can be placed around the user's arm. In this embodiment, around the user's arm, the device is comprised of an armband (1) consisting of a velcro band, the first half consisting of the hook side (15) and the second half consisting of the loop side (13), both resting on a strip (14) which can be made of neoprene so as to allow the diameter to be adjusted to the user's arm by means of a buckle (12) and another part consisting of an elastic band (10).

In alternative, the end of said strip (14) contains a locking part (16) made of metal or other resistant material, slightly wider than it, so as to make it difficult, although not impossible, for the end of this strip to pass through the buckle (12), for safety purposes.

The device is comprised of a rigid housing (2), composed of polymeric or composite material, being preferably spherical, flattened at the poles, which divides into two upper and lower parts along its longitudinal axis of symmetry, the connection between the two being made, for example, by means of a thread screw system (7). In a particular embodiment, said upper and lower parts have the same capacity.

The lower part of the housing (9) and the upper part of the housing (5) contain, perpendicularly to the elastic band, on two opposite sides and symmetrically, a small recess (6) which will have to coincide when joining these two parts composing the housing, in order to ensure due closure for safety purposes. This recess (6) thus ensures that the housing is completely sealed.

The lower part of the housing (9), which is concave and has a semi-spherical flattened shape on its pole, comprises means enabling the elastic band (10) to pass and slide on its outer face, for example symmetrically containing at its base, a U-shaped part (11) so as to enable the coupling of the device to the user's member. Alternatively, the lower part of the housing (9) may comprise two symmetrical bores (17) through which the elastic band (10) passes and slides.

The upper part of the housing (5), which is convex and has a flattened semi-spherical shape on its pole, consists at its top of at least one flexible tab (4) which follows the curvature of the flattened semi-sphere itself. If more than one tab is used, its arrangement may be symmetrical to one another, in which case the end of each tab is rounded and tapers towards the centre of the top of the part without them contacting, allowing access to the valve of the capsule inside the housing (2) when the latter is closed.

The present device also consists of a capsule (3) containing fluid or drug, also preferably of a spherical and flattened shape at the poles, so as to be arranged within the housing. This capsule (3) is composed of a flexible and resistant polymer, suitable for food or medical use, impermeable to water and gases, submersible, and able to undergo high and low temperatures, high and low pressures, but also different levels of humidity.

In the centre of the top of one of the capsule faces, which is in contact with the upper part of the housing, a valve is positioned. This valve is actuated by the pressure of the user's mouth on the capsule itself upon pressure of at least one flexible tab. In this way the valve is expelled from the inside of the capsule, allowing suctioning of the fluid or drug contained therein which, once ingested, enables the user to correct the reference values quickly and effectively.

In a particular embodiment, the capsule (3) is composed of a flexible and resistant polymer, suitable for food or medical use, impermeable to water, humidity and gases, the capsule being able to be submerged to a depth of −30 meters, undergo varying temperatures between −25° C. and 45° C., different pressures, altitudes and humidity levels in order to cover various environments and different atmospheric conditions.

The substance included inside the capsule is a fluid or drug adapted to the needs of the user. As an example, glucose syrup, antihypertensives, among others may be used.

When the capsule (3) is placed inside the housing (2), the face containing the valve (8) must be that in contact with the inside of the upper part of the housing (5), so that the valve (8) is accessible so as to be able to be pressed by the flexible tab (4) and thus release its contents.

In this way, the drug dispensing device allows the adequate correction of the reference values in a very fast and effective way by its user in adverse situations, namely in the practice of activities and sports considered of risk, such as mountaineering, skydiving, hang gliding, paragliding, hockey or jogging and, in particular, water environment activities or sports such as surfing, diving, windsurfing, kite surfing, rowing, bodyboarding, canoeing, rafting, paddle boarding, triathlon, diving or simply sailing, bathing in sea, lake or river water, safely without putting the health or life at risk.

The present technology is of course in no way restricted to the embodiments herein described, and a person of ordinary skill in the art will be capable of providing many modification possibilities thereto without departing from the general idea of the invention as defined in the claims.

All embodiments described above are obviously combinable with each other. The following claims further define preferred embodiments.

The invention claimed is:

1. A drug dispensing device that is waterproof and hands-free comprising:

a rigid housing composed of a lower part and an upper part, both parts connected to each other along a longitudinal axis of said rigid housing, forming an inner space delimited by inner faces of said lower and upper parts;

the upper part of the rigid housing comprising at least one flexible tab on a top of the upper part, the flexible tab designed for actuation via a user's mouth;

a capsule placed inside the rigid housing comprising a valve that is flexible, expellable and retractable; said valve positioned in the centre of the top of the capsule's face which is in contact with the upper part of the rigid housing;

wherein the device is configured to expel the valve from the inside of the capsule, becoming external to the boundary of the upper part of the housing, when pressure is applied to the at least one flexible tab which causes it to apply pressure to the capsule.

2. The drug dispensing device according to claim 1, wherein the rigid housing is composed of polymeric or composite material.

3. The drug dispensing device according to claim 1, wherein the at least one flexible tab comprises a plurality of flexible tabs that are symmetrical to each other.

4. The drug dispensing device according to claim 1, wherein the capsule is composed of polymeric material suitable for food or medical use, flexible, resistant, and impermeable to water and gases.

5. A drug dispensing device according to claim 1, wherein the lower part of the housing and the upper part of the housing comprises a recess which coincides when joining the two parts comprising the housing.

6. The drug dispensing device according to claim 1, comprising a thread screw system in the connection between the lower part of the housing and the upper part of the housing.

7. The drug dispensing device according to claim 1, wherein the lower part of the housing and the upper part of the housing are symmetrical in capacity.

8. The drug dispensing device according to claim 1, wherein the lower part of the housing comprises two symmetrical bores through which an elastic band passes and slides.

9. The drug dispensing device according to claim 1, comprising an armband consisting of an elastic band and a hook and loop fastener band, the first half consisting of the hook side and the second half consisting of the loop side, both resting on a strip.

10. The drug dispensing device according to claim 9, wherein the strap is neoprene.

11. The drug dispensing device according to claim 10, wherein the end of the strip contains a locking part.

12. The drug dispensing device according to claim 1, wherein the capsule is replaceable.

* * * * *